US005308260A

United States Patent [19]

Johnston et al.

[11] Patent Number: 5,308,260

[45] Date of Patent: May 3, 1994

[54] FRONT RELEASABLE MODULAR TELECOMMUNICATION JACK ADAPTER

[75] Inventors: James J. Johnston, Newington; John P. Goodsell, Stratford, both of Conn.

[73] Assignee: Hubbell Incorporated, Orange, Conn.

[21] Appl. No.: 938,714

[22] Filed: Sep. 1, 1992

[51] Int. Cl.[5] ..... H01R 4/50

[52] U.S. Cl. ..... 439/344; 439/352

[58] Field of Search ..... 439/344, 352, 353, 354, 439/304, 357, 358, 638, 676

[56] References Cited

U.S. PATENT DOCUMENTS

| | | | |
|---|---|---|---|
| 2,000,318 | 5/1935 | Cannon | 439/352 X |
| 2,421,974 | 12/1970 | Hardesty | 439/352 X |
| 3,953,098 | 4/1976 | Avery et al. | 439/352 X |
| 4,969,838 | 11/1990 | Himes, Jr. et al. | 439/353 X |
| 4,984,998 | 1/1991 | Ducan et al. | 439/352 |
| 5,090,916 | 2/1992 | Magnier | 439/352 |

*Primary Examiner*—Daniel W. Howell
*Assistant Examiner*—Khiem Nguyen
*Attorney, Agent, or Firm*—McCormick, Paulding & Huber

[57] ABSTRACT

A front releasable modular telecommunications jack adapter having a front part defined by at least one standard modular telephone jack and a rear part formed by a standard modular telephone plug. The plug is connected to the jack by a coupling member which comprises a rearward extension of the jack. A latch member supported on the plug for pivotal movement between latching and releasing positions is resiliently biased toward its latching position. A latch operator which includes an operating handle slidably supported within a slot in the telephone jack has an exposed portion forward of the jack and is connected to the latch member by an elongate flexible cord which extends through the adapter assembly.

18 Claims, 2 Drawing Sheets

FRONT RELEASABLE MODULAR TELECOMMUNICATION JACK ADAPTER

BACKGROUND OF THE INVENTION

This invention relates in general to electrical connectors and deals more particularly with an improved modular telecommunication jack adapter for plug-in connection with a standard modular telephone jack to alter the electrical output characteristics of the telephone jack.

The jack adapter of the present invention is intended for use with a standard modular telephone jack, such as an RJ-45 jack which terminates a plurality of electrical conductors. A modular telephone plug which mates with a modular telephone jack of the aforedescribed type has a standardized resilient cantilever latch member which is biased toward latching position to cooperate with the front wall of the telephone jack into which it is inserted to releasably secure the plug to the jack.

The latch member on the telephone plug must remain accessible for direct manual manipulation or manipulation by a special purpose tool to release the plug from the telephone jack. The spacial requirements imposed by this standardized latching system present a problem where it is desired to provide an array of jack adapters for use with a dense array of modular telephone jacks arranged in immediately adjacent rows and/or columns. The latch member on each of the inboard adapters in such an array is virtually inaccessible. To gain access to the latch member on a particular inboard adapter to separate it from the array it may be necessary to first release and remove several other adapters which comprise the array, thereby resulting in interruptions in service to the equipment served by the other adapters which must be removed.

Accordingly, it is the general aim of the present invention to provide an improved jack adapter for use with a standard telephone jack and having a more readily accessible latch releasing mechanism.

SUMMARY OF THE INVENTION

In accordance with the invention a front releasable modular telecommunication jack adapter is provided having an adapter body which includes a front part defining at least one forwardly open telecommunication plug receptacle and a rear part defining a rearwardly projecting telecommunication plug for plugging engagement with a mating standard telephone jack. Electrically conductive means connects contacts of a first group disposed within the plug receptacle to contacts of a second group carried by the telecommunication plug. A latch member supported on the rear part for movement between latching and releasing positions is resiliently biased toward its latching position. A latch operator supported on the adapter assembly for movement between inoperative and latch operating positions has a rigid portion exposed at the forward end of the front part. Attaching means which include a flexible member connects the latch operator to the latch member and moves the latch member from its latching position to its releasing position in response to forward movement of the latch operator from its inoperative position to a latch operating position.

DETAILED DESCRIPTION OF PREFERRED EMBODIMENTS

Figure 1:
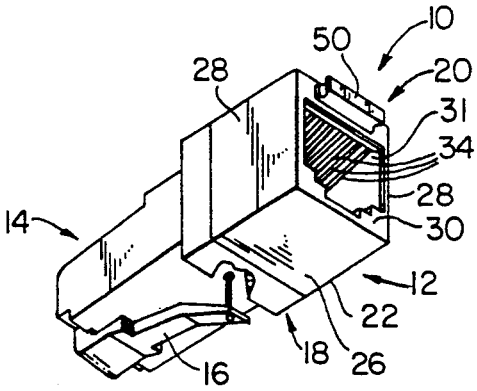
FIG. 1 is a perspective view of a front releasable modular telecommunications jack adapter embodying the present invention.
Figure 2:
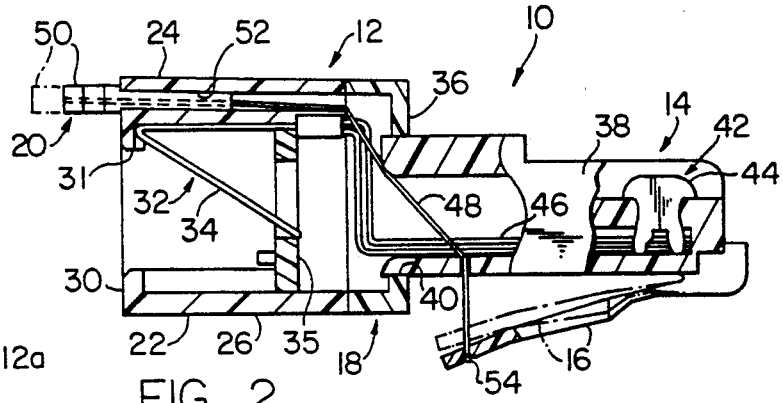
FIG. 2 is a somewhat enlarged side elevational view of the jack adapter shown partially in vertical section.

Turning now to the drawings and first referring to FIGS. 1–2, a front releasable modular telecommunication jack adapter embodying the present invention is indicated generally by the reference numeral 10. The illustrated adapter 10 is particularly adapted to be interposed between an associated standard modular telephone jack, such as an RJ 45 jack (not shown) containing an array of in-line electrical contacts terminating a plurality of electrical conductors, and a standard modular telephone plug having an array of in-line contacts to alter the number and/or sequential arrangement of the circuit paths from the in-line contacts on the telephone jack to the in-line contacts on the telephone plug.

The illustrated modular adapter 10 is hermaphroditic and essentially comprises a front part formed by a standard modular telecommunication plug receptacle or telephone jack, indicated generally at 12, and a rear part defined by a standard modular telecommunication or telephone plug, designated generally by the numeral 14, which includes a standardized integral latch member 16 supported for movement between latching and releasing positions and biased toward latching position. The front and rear parts of the jack adapter may be connected by various means. However, in accordance with the presently preferred construction, a coupling member, indicated generally at 18, connects the plug 14 to the jack 12 substantially as shown. Further, and in accordance with the invention, the adapter 10 includes a front operated latch releasing mechanism, indicated generally at 20, for moving the latch member 16 from its latching position to a releasing position. This front releasable feature facilitates convenient separation of the adapter 10 from an associated modular telephone jack (not shown) into which the adapter is plugged. This feature also renders the adapter 10 particularly suitable for use with an array of other adapters of like kind connected to a dense array of modular telephone jacks (not shown) arranged in immediately adjacent relation to each other and in rows and/or columns, all of which will be evident from the further description which follows.

Considering now the adapter 10 in further detail, the modular telecommunication jack 12 has a hollow generally rectangular housing 22 formed by a top wall 24, a bottom wall 26, a pair of opposing sidewalls 28, 28 and a front wall 30. The front wall has an opening 31 therein shaped to receive a standard modular telephone plug (not shown). Rearwardly facing shoulders on the rear surface of the front wall 30 cooperate in latching engagement with forwardly facing shoulders on a latch member carried by the modular telephone plug to releasably retain the telephone plug within the housing 22, in a manner well known in the telecommunication art. A first group of in-line contacts indicated generally at 32 and supported within the housing 22 includes a plurality of resilient cantilever spring contact members 34, 34 for establishing electrical connection with associated contacts on a modular telephone plug to be received within the housing. The free end of each contact member 34 is received within an associated slot formed in an insert 35 mounted within the housing 22. The insert aids in maintaining the spring contacts 34, 34 in parallel relation to each other.

The illustrated coupling member 18 comprises a generally rectangular forwardly open box shaped member preferably molded from the same dielectric material from which the housing 22 is made. The coupling member forms a rearward extension of the housing 22 and has a rear wall 36 and a cross-sectional configuration generally complementing the cross-sectional configuration of the rear end of the housing to which it is joined by ultrasonic welding or other appropriate means.

The modular telephone plug 14 has a generally rectangular body 38 made from dielectric material. The forward end of the body 38 is received within a complementary rectangular opening 40 formed within the rear wall 36 and is integrally joined to the coupling member 18 by ultrasonic welding or other suitable means. The latch member 16 is integrally connected by a live hinge to the lower surface of the body 38 near the rear end of the body and is resiliently biased away from the body and toward its latching position in a manner well known in the telecommunication art.

A second group of in-line electrical contacts indicated generally at 42 and carried by the telephone plug 14 include a plurality of spade contacts 44, 44 (one shown) exposed at the rear end of the plug 14 for engagement with associated spring contacts within a telephone jack (not shown) into which the adapter may be plugged. At least some of the contacts which comprise the second group 42 are electrically connected to contacts 34, 34 which comprise the first group 32 In addition to providing a means for attaching the telephone plug 14 to the telephone jack 12 the coupling member 18 also provides space rearward of the housing 22 for the cross-over of the insulated electrical conductors, indicated at 46, 46 (one shown) which connect contacts of the second group 42 to contacts of the first group 32 to facilitate various diverse circuit paths between the contacts of the two groups.

The front operated latch releasing mechanism 20 comprises an elongate flexible member card or 48 attached to the latch member 16 and a latch operator 50 attached to the flexible member and which has an exposed portion at the forward end of the front part of the adapter for operating the latch member 16. Preferably, and as shown, the latch operator 50 includes a rigid generally rectangular operating handle which defines the exposed portion of the operator. The latch operator 50 is slideable supported within a complimentary forwardly open slot 52 formed in the housing top wall 24, as best shown in FIG. 2. Preferably, and as shown, the flexible card 48 comprises a monofilament which is or may be molded into or otherwise integrally connected to the latch operator 50 and which extends through the front part of the adapter, through the coupling member 18 and downwardly through an opening in the rear part or plug 14. The lower end of the monofilament 48 passes through an opening in the latch member 16 and has an enlarged end portion, indicated at 54, which provides a means for attaching the filament to the latch member. The operating handle 50 is moveable between an inoperative position shown in full lines and an operative position indicated by broken lines in FIGS. 2. A pulling force applied to the handle to produce forward movement of the handle 50 to its operating position causes corresponding pivotal movement of the latch member 16 from its latching or full line position to its releasing or broken line position of FIG. 2.

Figure 3:
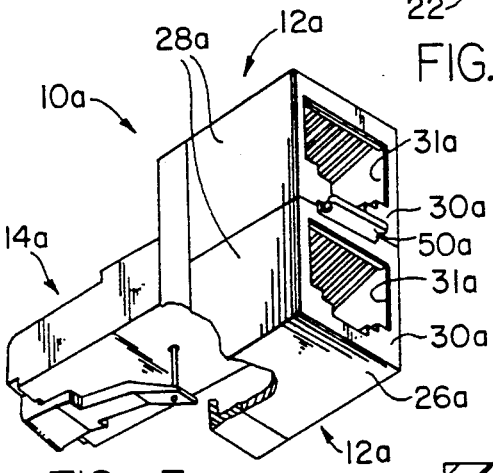
FIG. 3 is similar to FIG. 1 but shows another front releasable modular telecommunications jack adapter.
Figure 4:
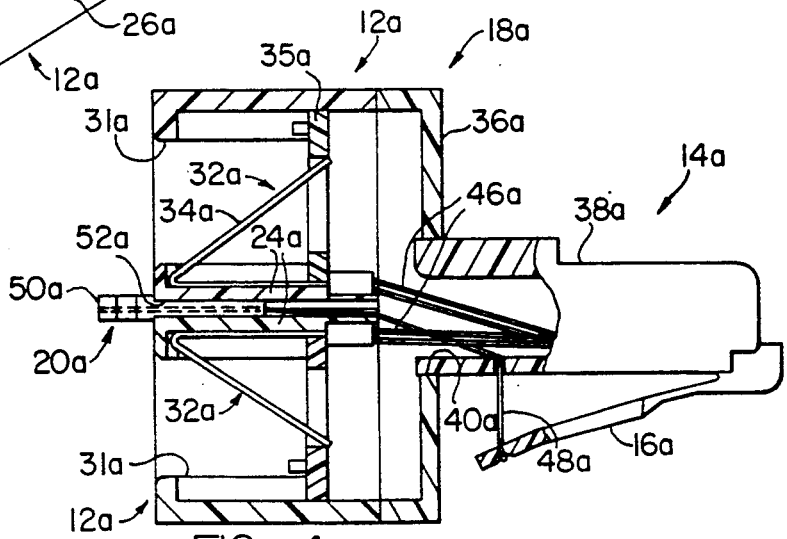
FIG. 4 is a somewhat enlarged side elevational view of the jack adapter of FIG. 3 shown partially in vertical section.
Figure 5:
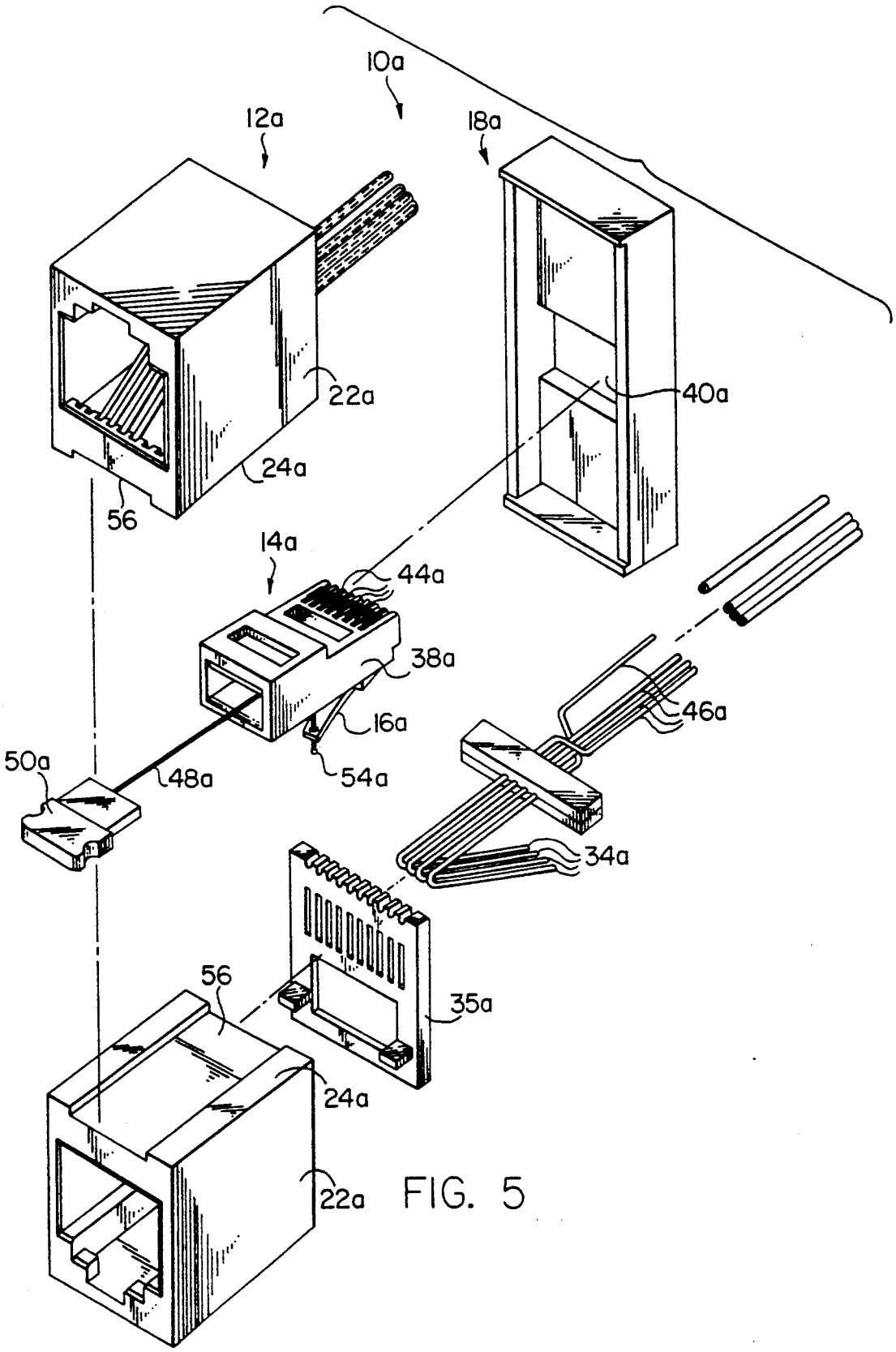
FIG. 5 is an exploded perspective view of the jack adapter shown in FIGS. 3 and 4.

Further referring to the drawings, and considering now particularly FIGS. 3–5. Another front releasable modular telecommunication jack adapter embodying the present invention is indicated generally at **10*a*. The adapter 10*a* is used to split the circuit paths terminated at an associated telephone jack into which the jack adapter 10*a* is plugged and is similar in many respects to the jack adapter 10, previously described. Parts of the adapter 10*a* which generally correspond to parts of the previously described adapter 10** bear the same reference numeral and a letter "a" suffix and will not be hereinafter discussed in detail.

The illustrated jack adapter **10*a* essentially comprises a standard modular telecommunication plug 14*a* connected to a pair of standard telecommunication plug receptacles 12*a*, 12*a* which include an upper plug receptacle and a lower plug receptacle. Each of the two plug receptacles 12*a*, 12*a* has a top wall 24*a* which defines a shallow forwardly open groove 56. The upper plug receptacle is assembled in an inverted position with the lower plug receptacle so that the top wall of the upper receptacle engages the top wall of the lower receptacle, substantially as shown. Thus, the two grooves 56, 56 cooperate to define a slot 52*a* having a generally rectangular cross-section which extends through the front part of the adapter assembly 10*a*. The plug 14*a* is connected to the plug receptacle assembly by a coupler 18*a* which defines a rearward extension of the latter housing assembly. Like the previously described coupling member the coupling member 18*a* has a rear wall defining a generally rectangular central opening 42*a* which receives the forward end portion of the plug 14*a***.

As previously noted, the adapter **10*a* is used to split the circuit paths terminated by an associated telephone jack into which it is plugged. Consequently, some of the spade contacts 44*a*, 44*a* carried by the telecommunication plug 14*a* are connected to spring contacts 34*a*, 34*a* in the upper plug receptacle 12*a* while other of the spade contacts 44*a*, 44*a* are connected to spring contacts in the lower plug receptacle 12*a*. Connection between the various contacts is provided by insulated conductors 46*a*, 46*a*. Where conductor crossovers are required, these crossovers generally occur within the coupling member 18*a***.

The front operated latch releasing mechanism **20*a* comprises a latch operator 50*a* which includes a rigid operating handle slidably supported within the slot 52*a* and an elongate flexible cord or monofilament 40*a* molded into or otherwise attached to the latch member 16*a*, in the manner previously described with reference to the adapter 10. A forwardly directed pulling force manually applied to the exposed portion of the latch operator 50*a* moves the latch member 16*a*** from its latching position to a releasing position, as previously described.

I claim:

1. A front releasable modular telecommunication jack adapter comprising an adapter assembly including an adapter body having a front part defining at least one forwardly open telecommunication plug receptacle and a rear part defining a rearwardly projecting telecommunication plug, a first group of contacts mounted within said plug receptacle, a second group of contacts carried by said telecommunication plug, electrically conductive means for connecting contacts of said first group to contacts of said second group, a latch member supported on said rear part for pivotal movement between latching and releasing positions and biased toward said latching position, a latch operator supported on said adapter assembly for movement between inoperative and latch operating positions and having an exposed portion at the forward end of said front part, and attaching means directly connected to said latch operator and to said latch member for pivoting said latch member from latching position to a releasing position in response to pulling force applied to said latch operator to move said latch operator in a direction away from said adapter body and from its inoperative position to a latch operating position.

2. A front releasable modular telecommunication jack adapter as set forth in claim 1 wherein said attaching means comprises an elongate flexible member.

3. A front releasable modular telecommunication jack adapter as set forth in claim 2 wherein said latch operator includes a substantially rigid member defining said exposed portion and said flexible member is connected to said rigid member and to said latch member.

4. A front releasable modular telecommunication jack adapter as set forth in claim 2 wherein said flexible member extends through said front part and through said rear part.

5. A front releasable modular telecommunication jack adapter as set forth in claim 2 wherein said flexible member comprises a monofilament.

6. A front releasable modular telecommunication jack adapter as set forth in claim 1 wherein said latch operator is supported for reciprocal sliding movement on said front part.

7. A front releasable modular telecommunication jack adapter as set forth in claim 6 wherein said latch operator is supported in a slot defined by said front part.

8. A front releasable modular telecommunication jack adapter as set forth in claim 1 including connecting means for securing said rear part to said front part.

9. A front releasable modular telecommunication jack adapter as set forth in claim 8 wherein said connecting means comprises a coupling member forming a rearward extension of said front part.

10. A front releasable modular telecommunication jack adapter as set forth in claim 1 wherein said front part comprises a plurality of telecommunication plug receptacles and said latch operator is supported on said front part between a pair of adjacent plug receptacles.

11. A front releasable modular telecommunication jack adapter as set forth in claim 10 wherein said latch operator is slidably supported on said front part.

12. A front releasable modular telecommunication jack adapter as set forth in claim 11 wherein said latch operator comprises a generally rectangular member slidably received within a slot formed in said front part.

13. A front releasable modular telecommunication jack adapter as set forth in claim 12 wherein said slot is partially defined by each of said adjacent plug receptacles.

14. A front releasable hermaphroditic modular telecommunication jack adapter comprising a body assembly including an adapter body having a front part defined by a generally rectangular housing having a front wall, said front wall having at least one telecommunication plug receiving opening therethrough and defining rearwardly facing shoulders for cooperating in latching engagement with forwardly facing shoulders on a latch element carried by a modular plug received within said one opening, a first group of electrical contacts including a plurality of resilient wire contacts supported in cantilever position within said housing, said adapter body having a rear part defined by a telecommunication plug, connecting means integrally securing said telecommunication plug to said housing, in rearwardly extending relation to said housing, a resilient latch member integrally connected to said telecommunication plug for generally pivotal movement between latching and releasing positions and resiliently biased toward its latching position, a second group of electrical contacts including a plurality of stationary contacts mounted in fixed position at the rear of said telecommunication jack, electrically conducting means for connecting contacts of said first group to contacts of said second group, and means for operating said latch member including a latch operator having a flexible end portion connected directly to said latch member and a rigid end portion exposed forwardly of the forward end of said housing.

15. A front releasable hermaphroditic modular telecommunication jack adapter as set forth in claim 14 wherein said connecting means comprises a rearward extension of said housing.

16. A front releasable modular telecommunication jack adapter comprising an adapter body having a front part defining at least one forwardly open telecommunication jack and a rear part defining a rearwardly projecting telecommunication plug, first group of contacts including a plurality of contacts disposed within said one jack, a second group of contacts including a plurality of contacts carried by said telecommunication plug, electrically conductive means for connecting contacts of said first group to contacts of said second group, a latch member supported on said rear part for movement between latching and releasing positions and biased toward said latching position, and latch operating means for moving said latch member from said latching to said releasing position and including a latch operator having a flexible member connected to said latch member and a rigid member connected to said flexible member, said rigid member having a part thereof exposed at the forward end of said front part.

17. A front releasable modular telecommunication jack as set forth in claim 2 wherein said flexible member comprises a cord.

18. A front releasable modular telecommunication jack as set forth in claim 14 wherein said latch operator is supported for reciprocal sliding movement by said front part and said latch member is moveable to a releasing position in response to a pulling force applied to said latch operator.

* * * * *